US006608632B2

(12) United States Patent
Daly et al.

(10) Patent No.: US 6,608,632 B2
(45) Date of Patent: Aug. 19, 2003

(54) METHODS AND SYSTEMS FOR IMPROVING DISPLAY RESOLUTION IN IMAGES USING SUB-PIXEL SAMPLING AND VISUAL ERROR FILTERING

(75) Inventors: Scott J. Daly, Kalama, WA (US); Rajesh Reddy K. Kovvuri, Clemson, SC (US)

(73) Assignee: Sharp Laboratories of America, Inc., Camas, WA (US)

( * ) Notice: Subject to any disclaimer, the term of this patent is extended or adjusted under 35 U.S.C. 154(b) by 288 days.

(21) Appl. No.: 09/735,424

(22) Filed: Dec. 12, 2000

(65) Prior Publication Data

US 2002/0093521 A1 Jul. 18, 2002

Related U.S. Application Data

(60) Provisional application No. 60/211,020, filed on Jun. 12, 2000.

(51) Int. Cl.[7] ..... G09G 5/02

(52) U.S. Cl. ..... 345/698; 345/611; 382/275

(58) Field of Search ..... 345/698, 699, 345/603, 604, 611, 613, 616, 3.3, 3.4; 348/450; 382/275, 274, 254, 263, 264, 299

(56) References Cited

U.S. PATENT DOCUMENTS

| | | | | |
|---|---|---|---|---|
| 5,254,982 A | | 10/1993 | Feigenblatt et al. | 345/178 |
| 5,339,092 A | | 8/1994 | Johnson et al. | 345/136 |
| 5,528,740 A | * | 6/1996 | Hill et al. | 345/428 |
| 5,949,428 A | | 9/1999 | Toelle | 345/431 |
| 6,018,596 A | * | 1/2000 | Wilkinson | 382/260 |
| 6,020,868 A | | 2/2000 | Greene et al. | 345/88 |
| 6,192,162 B1 | * | 2/2001 | Hamilton, Jr. et al. | 382/266 |

OTHER PUBLICATIONS

Article Entitled "Full Color Imaging On Amplitude Color Mosiac Displays" by R. Feigenblatt, 1989 Proc. SPIE V. 1075,pp. 199–205.

Article Entitled "Color Matrix Display Image Quality," by J, Kranz and L. Silverstein, 1990 SID Symp. Digest pp. 29–32.

Article Entitled "Color Matrix Display Simulation Based upon Luminance and Chromatic Contrast Sensitivity of Early Vision" by, R. Martin, A. Ahumada and J. Larimer, SPIE, 1992, vol. 1666, pp. 336–342.

Article Entitled "A Spatial Extension Of CIELAB For Digital Color Image Reproduction" by X. Zhang and B. Wandell, SID symp. 1996, Digest pp. 731–734.

(List continued on next page.)

*Primary Examiner*—Bipin Shalwala
*Assistant Examiner*—Ricardo Osorio
(74) *Attorney, Agent, or Firm*—Scott C. Krieger; David C. Ripma; Matthew D. Rabdau

(57) ABSTRACT

Embodiments of the present invention provide systems and methods for converting a higher-resolution image to a lower-resolution image with reduced visible errors. These embodiments comprise splitting a higher-resolution opponent color domain (OCD) image into separate initial luminance and initial chrominance channels followed by sub-pixel sampling on said initial luminance channel thereby creating an additive color domain (ACD) luminance image. This ACD luminance image is then converted into an OCD luminance image and split into separate sub-pixel sampled (SPS) luminance and SPS chrominance channels. The SPS chrominance channels are high-pass filtered and the initial chrominance channels are low-pass filtered. The filtered initial chrominance channels are sub-sampled and combined with the high-pass filtered SPS chrominance channels. These combined chrominance channels are then combined with said SPS luminance channel to form an error-reduced lower-resolution image.

17 Claims, 8 Drawing Sheets

OTHER PUBLICATIONS

Article Entitled "Displaced Filtering For Patterned Displays" by C. Betrisey, et al, 2000, SID00 Symposium Digest, pp. 296–299.

Article Entitled "Visible Differences Predictor" by S.Daly,, Ch 14 Digital Images and Human Vision, 1993, MIT Press pp. 181–206.

Article Entitled "A Visual Discrimination Model For Imaging System Design And Evaluation" Ch. 10 of Vision Models for Target Detection and Recognition, By J.Lubin, 1995, World Scientific Press.

* cited by examiner

METHODS AND SYSTEMS FOR IMPROVING DISPLAY RESOLUTION IN IMAGES USING SUB-PIXEL SAMPLING AND VISUAL ERROR FILTERING

CROSS REFERENCE TO RELATED APPLICATIONS

This application claims the benefit of U.S. Provisional Patent Application No. 60/211,020, filed Jun. 12, 2000.

The subject matter of this application is related to an application entitled "Methods and Systems for Improving Display Resolution using Sub-Pixel Sampling and Visual Error Compensation" invented by Scott Daly and filed on the same date as this application with Express Mailing Label No. EF 244380501 US and given U.S. Pat. Ser. No. 09/735,454. This application is hereby incorporated herein by reference.

The subject matter of this application is also related to an application entitled "Methods and Systems for Improving Display Resolution in achromatic Images using Sub Pixel Sampling and Visual Error Filtering" invented by Rajesh Reddy K. Kovvuri and Scott Daly and filed on the same date as this application with Express Mailing Label No. EF 244380515 US and given U.S. Pat. Ser. No. 09/735,425. This application is hereby incorporated herein by reference.

THE FIELD OF THE INVENTION

Embodiments of the present invention relate to the field of displaying high resolution images on displays with lower resolution, where the displays use a triad arrangement to display the R, G, and B or other components of the image. This triad arrangement is common in direct view LCD displays, for example, and in such an arrangement, a single pixel is composed of 3 side-by-side subpixels. Each subpixel controls only one of the three primaries (i.e., R, G and B) and is, in turn, usually controlled solely by the primaries of the digital image representation. The high-resolution image may be available in memory, or may be available directly from an algorithm (vector graphics, some font designs, and computer graphics).

BACKGROUND

The most commonly used method for displaying high-resolution images on a lower resolution display is to sample the pixels 2 of the high-resolution image 4 down to the resolution of the low-resolution display 6, as shown in FIG. 1. Then, the R, G, B values of each downsampled color pixel 8 are mapped to the separate R, G, B elements 10, 12 and 14 of each display pixel 16. These R, G, B elements 10, 12 and 14 of a display pixel are also referred to as subpixels. Because the display device does not allow overlapping color elements, the subpixels can only take on one of the three R, G, or B colors, however, the color's amplitude can be varied throughout the entire greyscale range (e.g., 0–255). The subpixels usually have a 1:3 aspect ratio (width:height), so that the resulting pixel 16 is square. The subsampling/mapping techniques do not consider the fact that the display's R, G, and B subpixels are spatially displaced; in fact they are assumed to be overlapping in the same manner as they are in the high-resolution image. This type of sampling may be referred to as sub-sampling or traditional sub-sampling.

The pixels of the high-resolution image 4 are shown as three slightly offset stacked squares 8 to indicate their RGB values are associated for the same spatial position (i.e., pixel). One display pixel 16, consisting of one each of the R, G and B subpixels 10, 12 and 14 is shown as part of the lower-resolution triad display 6 in FIG. 1 using dark lines. Other display pixels are shown with lighter gray lines.

In this example, the high-resolution image has 3× more resolution than the display (in both horizontal and vertical dimensions). Since this direct subsampling technique causes aliasing artifacts, various methods are used, such as averaging the neighboring unsampled pixels in with the sampled pixel. Note that the common technique of averaging neighboring elements while subsampling is mathematically equal to prefiltering the high resolution image with a rectangular (rect) filter. Also, note that techniques of selecting a different pixel than the leftmost (as shown in this figure) can be considered as a prefiltering that affects only phase. Thus, most of the processing associated with preventing aliasing can be viewed as a filtering operation on the high-resolution image, even if the kernel is applied only at the sampled pixel positions.

An achromatic image, as defined in this specification and claims has no visible color variation. This achromatic condition can occur when an image contains only one layer or color channel, or when an image has multiple layers or color channels, but each color layer is identical thereby yielding a single color image.

It has been realized that the aforementioned technique does not take advantage of potential display resolution. Background information in this area may be accessed by reference to R. Fiegenblatt (1989), "Full color imaging on amplitude color mosaic displays" Proc. SPIE V. 1075, 199–205; and J. Kranz and L. Silverstein (1990) "Color matrix display image quality: The effects of luminance and spatial sampling", SID Symp. Digest 29–32 which are hereby incorporated herein by reference.

For example, in the display shown in FIG. 1, while the display pixel 16 resolution is ⅓ that of the high resolution image (source image) 4, the subpixels 10, 12 and 14 are at a resolution equal to that of the source (in the horizontal dimension). If this display were solely to be used by colorblind individuals, it would be possible to take advantage of the spatial positions of the subpixels. This approach is shown in FIG. 2 below, where the R, G, and B subpixels 10, 12 and 14 of the display are taken from the corresponding colors of different pixels 11, 13 and 15 of the high-resolution image. This allows the horizontal resolution to be at the subpixel resolution, which is 3× that of the display pixel resolution.

But what about the viewer of the display who is not color-blind? That is, the majority of viewers. Fortunately for display engineers, even observers with perfect color vision are color blind at the highest spatial frequencies. This is indicated below in FIG. 3, where idealized spatial frequency responses of the human visual system are shown.

Here, luminance 17 refers to the achromatic contact of the viewed image, and chrominance 19 refers to the color content, which is processed by the visual system as isoluminant modulations from red to green, and from blue to yellow. The color difference signals R–Y and B–Y of video are rough approximations to these modulations. For most observers, the bandwidth of the chromatic frequency response is ½ that of the luminance frequency response. Sometimes, the bandwidth of the blue-yellow modulation response is even less, down to about ⅓ of the luminance. Sampling which comprises mapping of color elements from different image pixels to the subpixels of a display pixel triad may be referred to as sub-pixel sampling.

With reference to FIG. 4, in the horizontal direction of the display, there is a range of frequencies that lie between the Nyquist of the display pixel 16 (display pixel=triad pixel, giving a triad Nyquist at 0.5 cycles per triad pixel) and the Nyquist frequency of the sub-pixels pixels elements 10, 12 and 14 (0.5 cycles per subpixel=1.5 cycles/triad pixels). This region is shown as the rectangular region 20 in FIG. 4. The resulting sinc functions from convolving the high resolution image with a rect function whose width is equal to the display sample spacing is shown as a light dashed-dot curve 22. This is the most common approach taken for modeling the display MTF (modulation transfer function) when the display is an LCD.

The sinc function resulting from convolving the high-res source image with a rect equal to the subpixel spacing is shown as a dashed curve 24, which has higher bandwidth. This is the limit imposed by the display considering that the subpixels are rect in 1D. In the shown rectangular region 20, the subpixels can display luminance information, but not chromatic information. In fact, any chromatic information in this region is aliased. Thus, in this region, by allowing chromatic aliasing, we can achieve higher frequency luminance information than allowed by the triad (i.e., display) pixels. This is the "advantage" region afforded by using sub-pixel sampling.

For applications with font display, the black & white fonts are typically preprocessed, as shown in FIG. 5. The standard pre-processing includes hinting, which refers to the centering of the font strokes on the center of the pixel, i.e., a font-stroke specific phase shift. This is usually followed by low-pass filtering, also referred to as greyscale antialiasing.

The visual frequency responses (CSFs) shown in FIG. 3 are idealized. In practice, they have a finite falloff slope, as shown in FIG. 6A. The luminance CSF 30 has been mapped from units of cy/deg to the display pixel domain (assuming a viewing distance of 1280 pixels). It is shown as the solid line 30 that has a maximum frequency near 1.5 cy/pixel (display pixel), and is bandpass in shape with a peak near 0.2 cy/pixel triad. The R:G CSF 32 is shown as the dashed line, that is lowpass with a maximum frequency near 0.5 cy/pixel. The B:Y modulation CSF 34 is shown as the dashed-dotted LPF curve with a similar maximum frequency as the R:G CSF, but with lower maximum response. The range between the cutoff frequencies of the chroma CSF 32 and 34 and the luminance CSF 30 is the region where we can allow chromatic aliasing in order to improve luminance bandwidth.

FIG. 6A also shows an idealized image power spectra 36 as a 1/f function, appearing in the figure as a straight line with a slope of −1 (since the figure is using log axes). This spectrum will repeat at the sampling frequency. These repeats are shown for the pixel 38 and the subpixel 40 sampling rates for the horizontal direction. The one occurring at lower frequencies 38 is due to the pixel sampling, and the one at the higher frequencies 40 is due to the subpixel sampling. Note that the shapes change since we are plotting on a log frequency axis. The frequencies of these repeat spectra that extend to the lower frequencies below Nyquist are referred to as aliasing. The leftmost one is chromatic aliasing 38 since it is due to the pixel sampling rate, while the luminance aliasing 40 occurs at higher frequencies because it is related to the higher sub-pixel sampling rate.

In FIG. 6A, no prefiltering has been applied to the source spectra. Consequently, aliasing, due to the pixel sampling (i.e., chromatic aliasing), extends to very low frequencies 35. Thus even though the chromatic CSF has a lower bandwidth than the luminance CSF, the color artifacts may still be visible (depending on the noise and contrast of the display).

In FIG. 6B, we have applied the prefilter (a rect function equal to three source image pixels), shown in FIG. 4 as a dashed-dotted line 22, to the source power spectrum, and it can be seen to affect the baseband spectrum 42 past 0.5 cy/pixel, causing it to have a slope steeper than −1 shown at 44. The repeats also show the effect of this prefilter. Even with this filter, we see that some chromatic aliasing (the repeated spectrum at the lower frequencies) occurs at frequencies 46 lower than the cut-off frequency of the two chrominance CSFs 32*a* and 34*a*. Thus it can be seen that simple luminance prefiltering will have a difficult time removing chromatic aliasing, without removing all the luminance frequencies past 0.5 cy/pix (i.e., the "advantage" region).

Since we are relying on the visual system differences in bandwidth as a function of luminance or chrominance to give us a luminance bandwidth boost in the "advantageous region", one possibility is to design the prefiltering based on visual system models as described in C. Betrisey, et al (2000), "Displaced filtering for patterned displays," SID Symposium digest, 296–299, hereby incorporated herein by reference and illustrated in FIG. 7.

This technique ideally uses different prefilters depending on which color layer, and on which color subpixel the image is being sampled for. Thus there are 9 filters. They were designed using a human visual differences model described in X. Zhang and B. Wandell (1996) "A spatial extension of CIELab for digital color image reproduction", SID Symp. Digest 731–734, incorporated herein by reference and shown in the FIG. 7. This was done offline, assuming the image is always black & white. In the final implementation, rect functions rather than the resulting filters are used in order to save computations. In addition, there is still some residual chromatic error that can be seen because the chromatic aliasing extends down to lower frequencies than the chromatic CSF cutoff (as seen in FIG. 6B).

However, the visual model used does not take into account the masking properties of the visual system which cause the masking of chrominance by luminance when the luminance is at medium to high contrast levels. So, in larger fonts the chromatic artifacts, which lie along the edges of the font, are masked by the high luminance contrast of the font. However, as the font size is reduced the luminance of the font reduces, and then the same chromatic artifacts become very visible (at very small fonts for example, the b/w portion of the font disappears, leaving only a localized color speckle).

SUMMARY OF THE INVENTION

Embodiments of the present invention comprise methods and systems that rely less on filtering and its assumptions of linearity and are capable of working on input color images. These embodiments are capable of directly removing low frequency chromatic artifacts after they are caused by sub-pixel sampling. This is achieved by generating a LPF version of the chromatic content of the image which is added to the luminance and chromatic aliasing versions. This is done by making use of color domains other than additive, primary color domains (i.e., RGB) to remove the color artifacts caused by the sub-pixel sampling. In practice, only the lower frequency chromatic artifacts need to be cancelled, since the high frequency ones cannot be seen due to the lower bandwidth of the chromatic CSFs, as shown in FIG. 6A.

The methods and systems of the present invention may be used in obtaining higher resolution luminance signals with no visibility of chromatic aliasing, when the display is viewed no closer than designed specifications. These techniques do not need the assumption that the source image is text, or that the images are achromatic.

Embodiments of the present invention convert a higher-resolution image to a lower-resolution image with reduced errors caused by the sub-sampling processes. When the higher-resolution image is not in a format which allows separation of luminance and chrominance data, the image is converted to such a format. Many opponent color domains are acceptable. The opponent color domain image is split thereby separating the luminance channel from the chrominance channels thereby allowing for separate processing.

The luminance channel is then converted to an additive color domain (ACD), such as RGB, and the ACD luminance image is sub-pixel sampled to preserve luminance data while reducing resolution. Following sub-pixel sampling, the sub-pixel sampled (SPS) image is converted back to an opponent color domain (OCD) and again split into separate luminance and chrominance channels. The SPS chrominance channels produced by this split are then high-pass filtered to remove low-frequency artifacts produced during sub-pixel sampling. The SPS luminance channel is typically not modified to preserve original luminance data.

The chrominance channels from the original image are low-pass filtered and then sub-sampled to provide the chrominance data for the lower-resolution image. These low-pass filtered chrominance channels are then combined with the high-pass filtered, sub-pixel sampled chrominance channels created from the original luminance channel. These combined chrominance channels are also combined with the SPS luminance channel to form a reduced-error, lower-resolution image, generally in an opponent color domain. This error-reduced, lower-resolution image may then be converted to an additive color domain or some other color domain compatible with the desired application.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
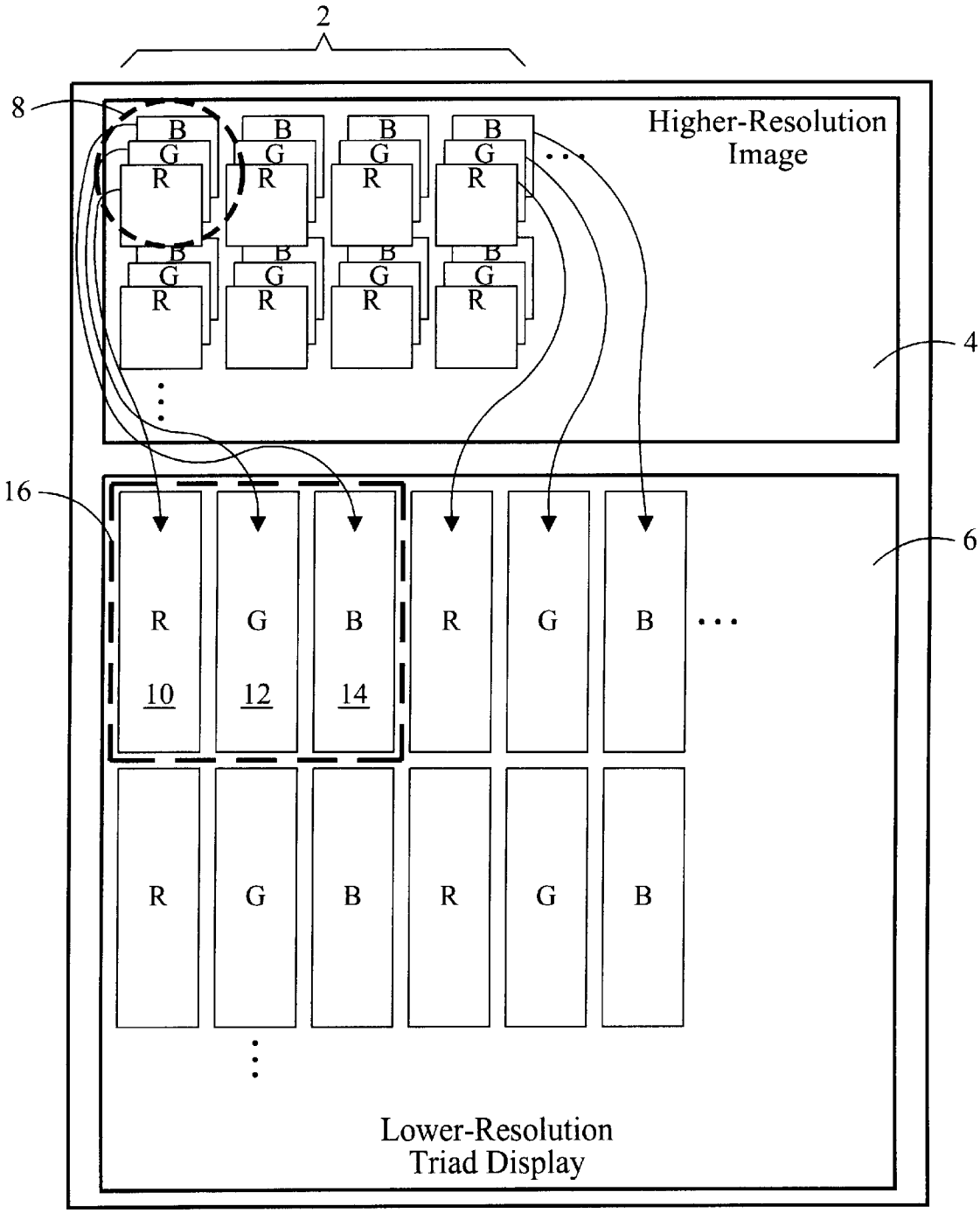
FIG. 1 is a diagram showing traditional image sampling for displays with a triad pixel configuration.
Figure 2:
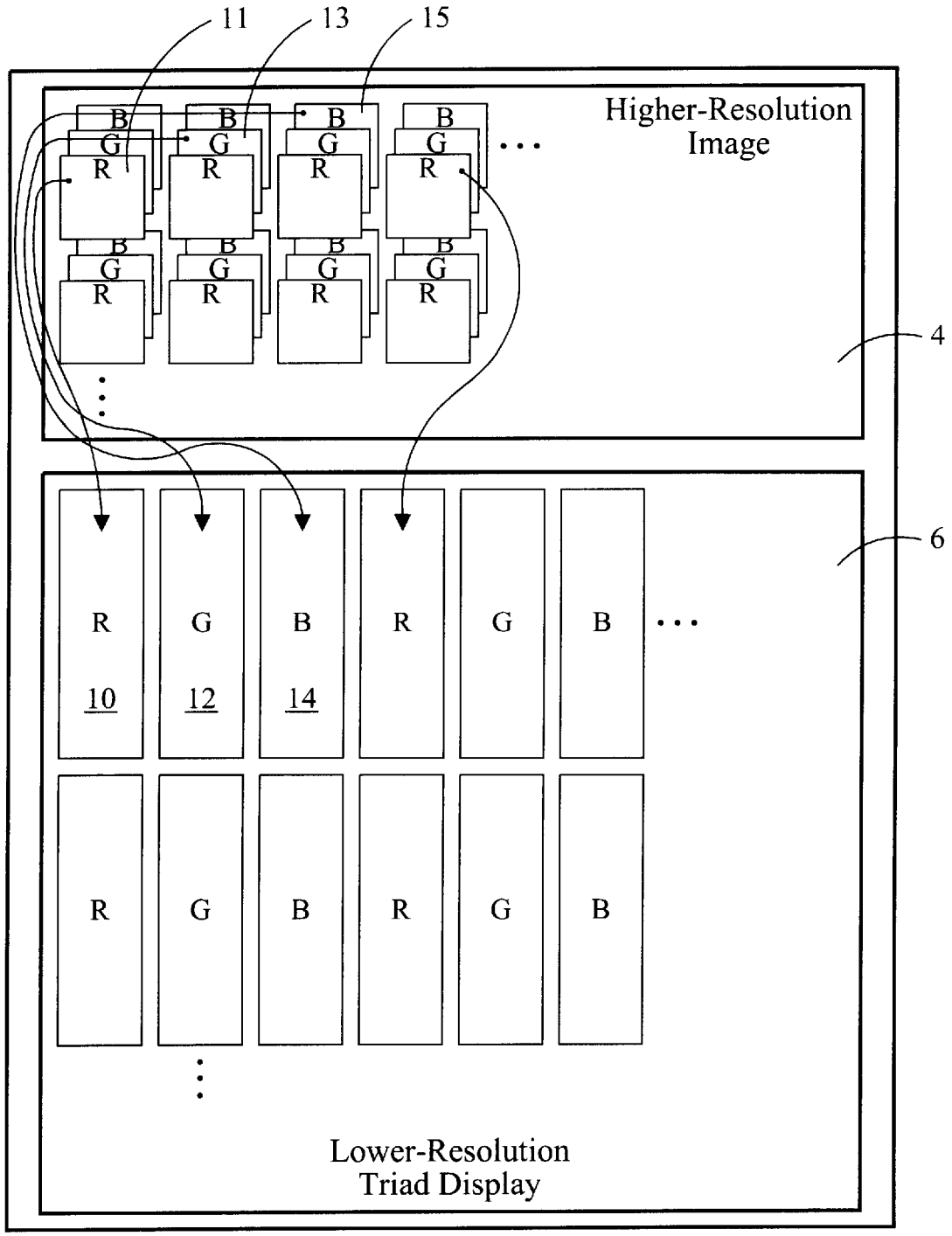
FIG. 2 is a diagram showing sub-pixel image sampling for a display with a triad pixel configuration.
Figure 3:
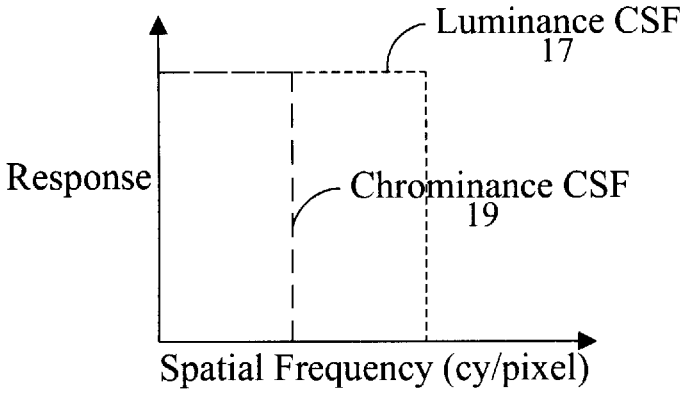
FIG. 3 is a graph showing idealized CSFs mapped to a digital frequency plane.
Figure 4:
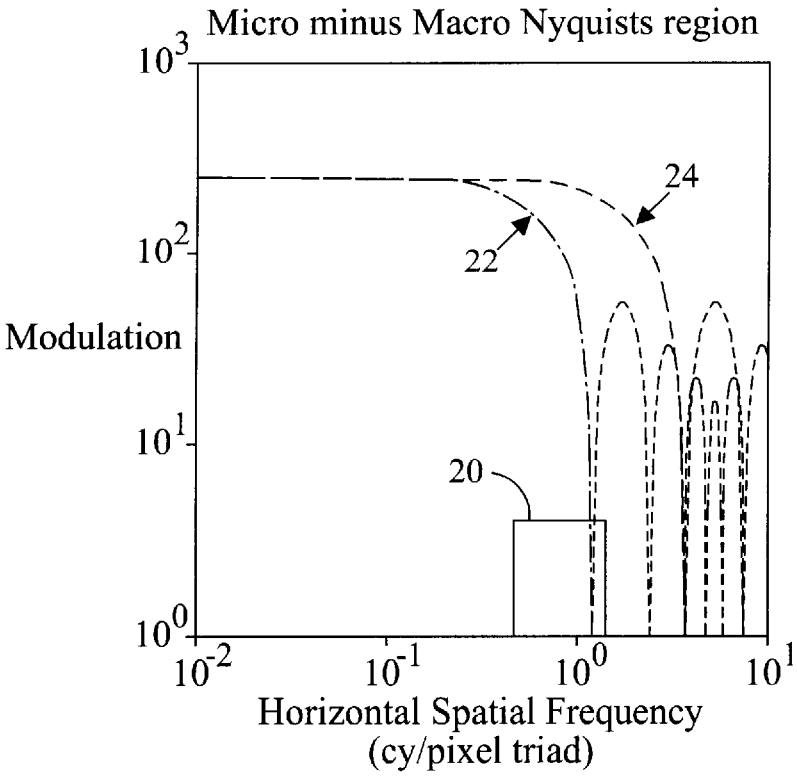
FIG. 4 is a graph showing an analysis of the pixel Nyquist and sub-pixel Nyquist regions which denotes the advantage region.
Figure 5:
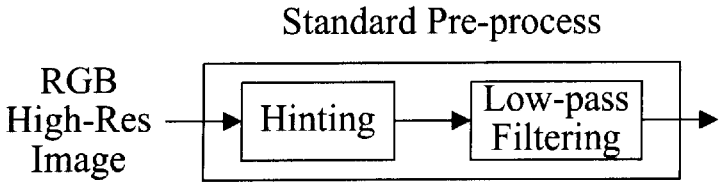
FIG. 5 shows typical pre-processing techniques.
Figure 6A:
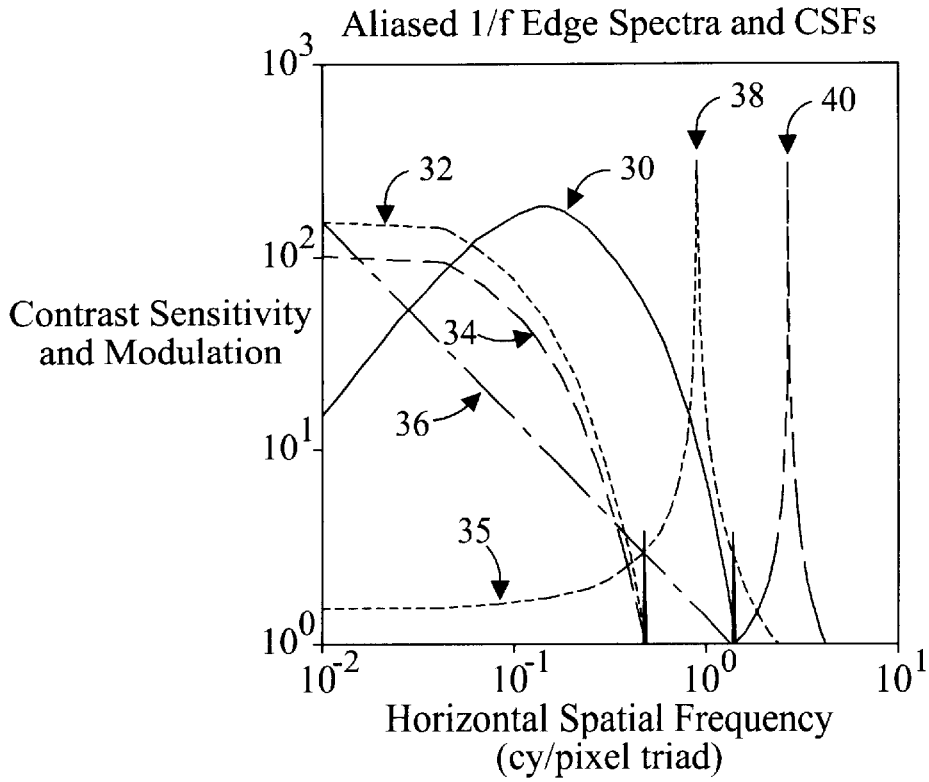
FIG. 6A is a graph showing an analysis using 1/f-power spectra repeated at pixel sampling and sub-pixel sampling frequencies.
Figure 6B:
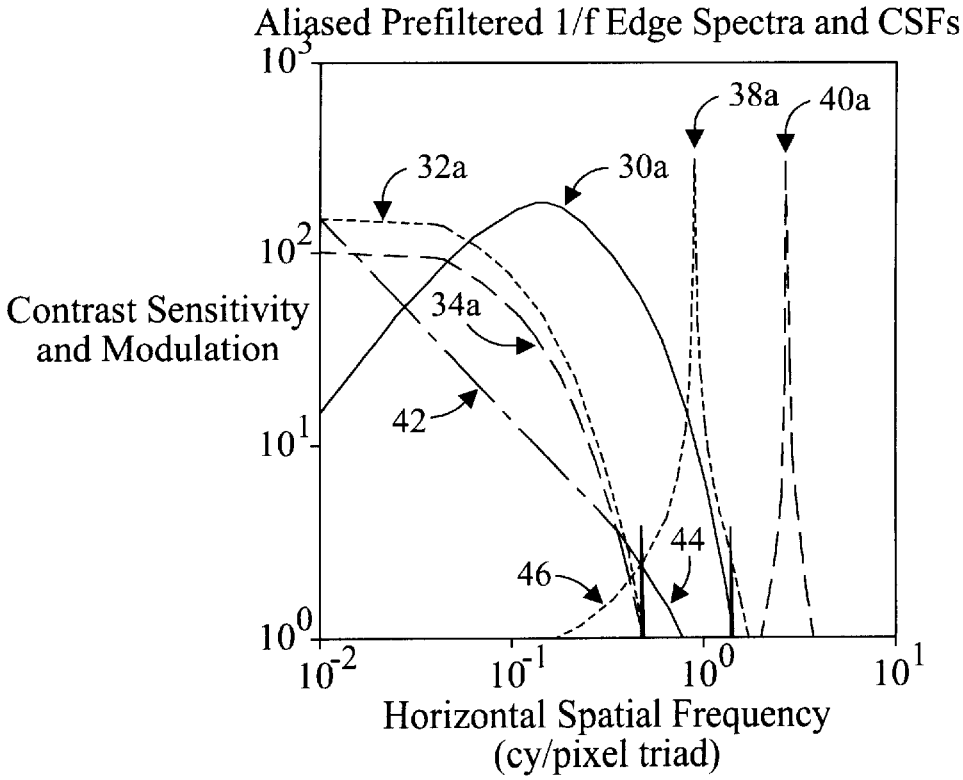
FIG. 6B is a graph showing an analysis using 1/f-power spectra repeated at pixel sampling and sub-pixel sampling frequencies with improvements due to pre-processing.
Figure 7:
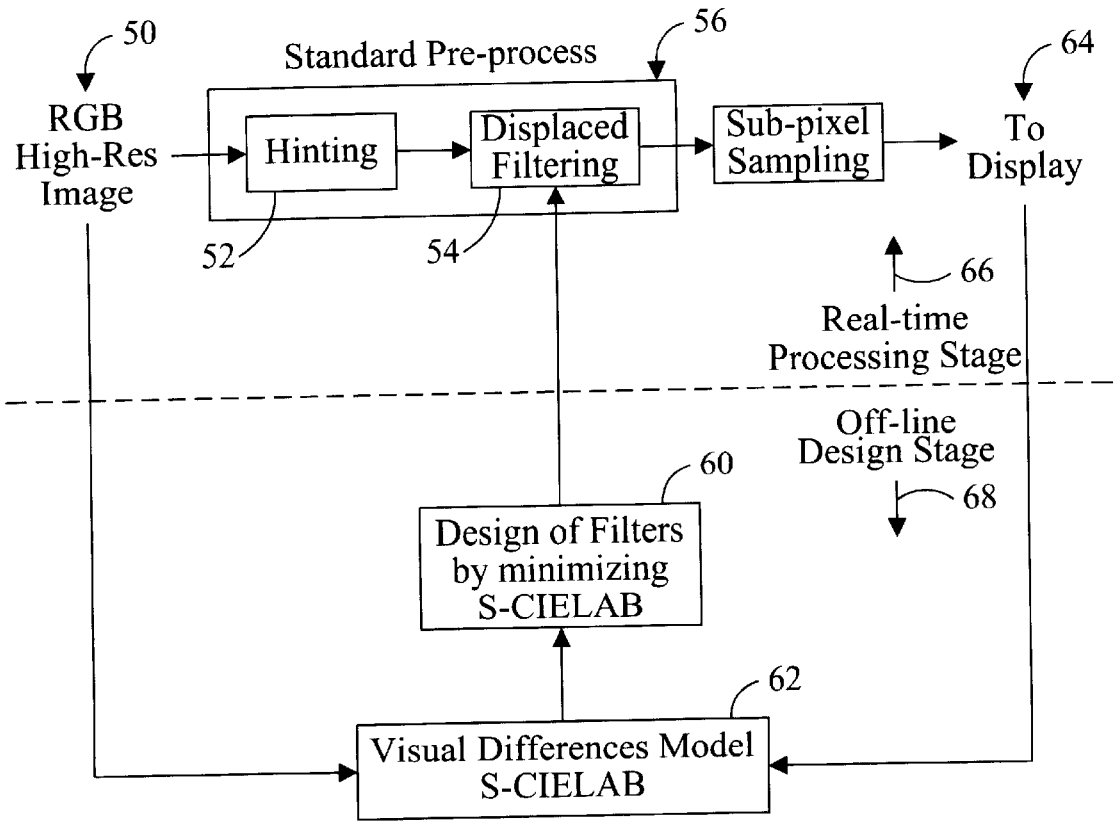
FIG. 7 is a block diagram showing a known use of a visual model.

The currently preferred embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

Embodiments of the present invention may be described and claimed with reference to the term "achromatic". This term, as used in conjunction with images in this specification and appended claims, refers to an image that has no visible color variation. An achromatic image may be an image that contains only one layer or color channel, or an image that has multiple layers or color channels, but each color layer is identical thereby yielding a single color image.

Embodiments of the present invention may be described and claimed with reference to "RGB" images or domains, or "additive color domains" or "additive color images". These terms, as used in this specification and related claims, may refer to any form of multiple component image domain with integrated luminance and chrominance information including, but not limited to various RGB domains and CMYK domains.

Embodiments of the present invention may also be described and claimed with reference to "YCrCb" images or domains, "opponent color" domains, images or channels, or "color difference" domains, images or channels. These terms, as used in this specification and related claims, may refer to any form of multiple component image domain with channels which comprise at least one distinct luminance channel and chrominance channels including, but not limited to YCrCb, LAB, YUV, and YIQ domains.

Embodiments of the present invention may be used to convert higher-resolution images to lower-resolution images with fewer visible errors in the converted image. While these embodiments are typically used in conjunction with a display device to convert images which have a higher resolution than the display down to a resolution that is usable by the display, other applications are applicable.

Images converted with embodiments of the present invention may exist in a variety of formats. When these formats are not compatible with the processes of embodiments of the present invention, the images may be converted to a compatible format prior to processing and may be converted back, when necessary, after processing.

Figure 8:
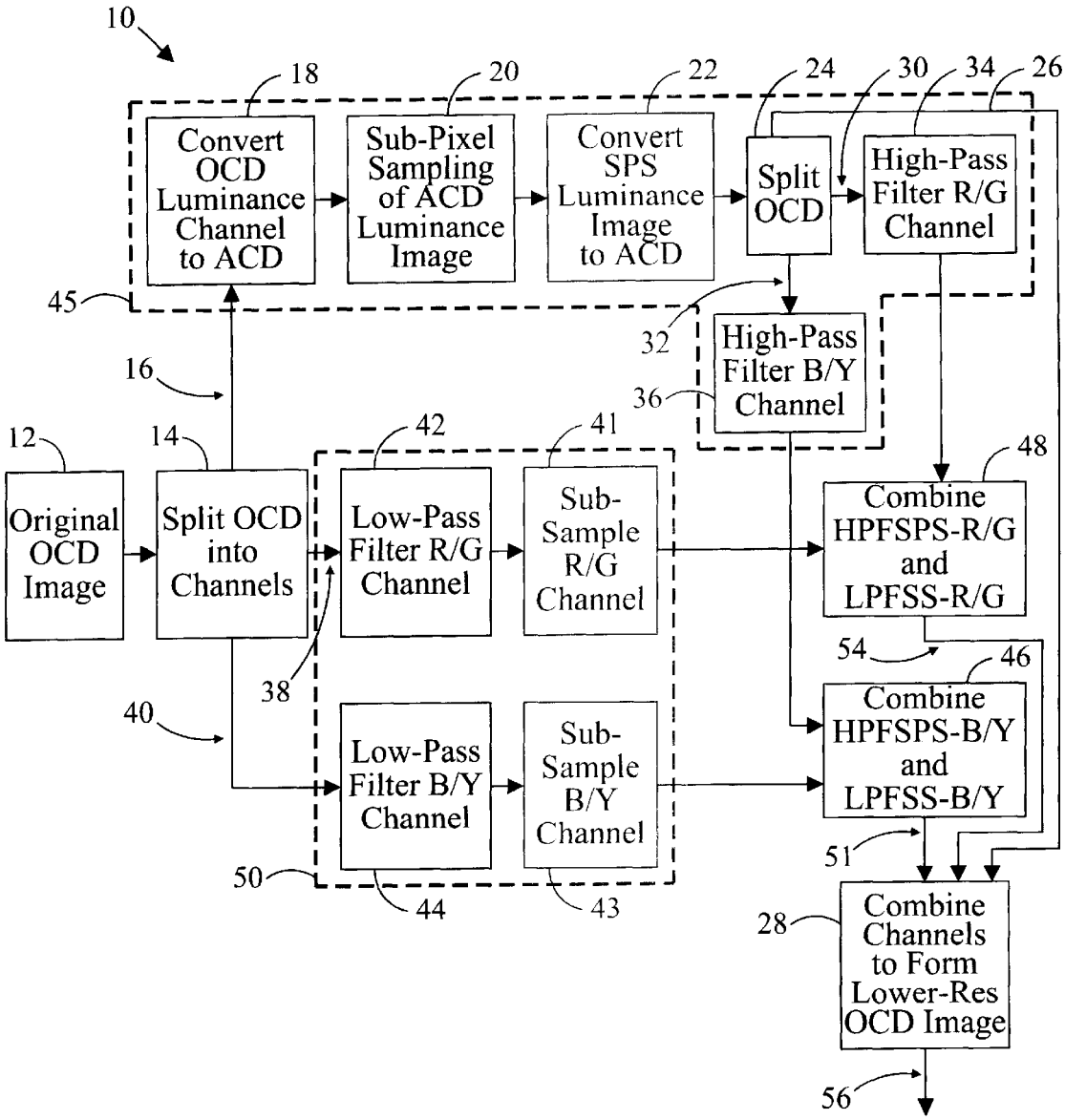
FIG. 8 is a diagram showing embodiments of the present invention.

Embodiments of the present invention may be explained in reference to FIG. 8 which depicts a diagram summarizing exemplary embodiments. This process begins with an image that exists in an opponent color domain (OCD) such as a YCrCb, LAB, YUV, YIQ or similar domain. When an image exists in an additive color domain (ACD) such as a RGB or CMYK domain or some other color space, the image may be converted to an opponent color domain prior to processing with an embodiment of the present invention. Some embodiments include steps to convert images into a compatible format prior to processing.

Once an image is in an opponent color domain 12, with a distinct luminance channel and chrominance channels, the image is "split" 14 to provide for separate processing of luminance and chrominance channels. "Splitting" 14 may comprise sampling or filtering of the original OCD image 12 or other methods of isolating luminance and chrominance data from the original image 12. Splitting may also comprise image conversion.

After splitting, the initial luminance channel 16 is converted 18 to an ACD luminance image, such as a RGB image. This is done to enable sampling of the luminance image in the format or domain in which it will eventually be displayed. Once the luminance image is converted 18, sub-pixel sampling 20 is performed on the image to improve the resolution of the resulting lower-resolution image. In this manner, the luminance data from each successive pixel in the original higher-resolution image is assigned to each corresponding sub-pixel in the lower-resolution image.

When sub-pixel sampling 20 is complete, resulting in a lower-resolution, sub-pixel sampled (SPS) luminance image, this SPS luminance image is converted 22 to an OCD image which may be referred to as a SPS-OCD luminance image. This conversion is performed to allow for further splitting 24 of the SPS luminance image into distinct luminance and chrominance channels. The SPS luminance channel 26 is typically left undisturbed until subsequent combination 28 with other channels. However, the SPS chrominance channels are filtered prior to further combination.

These SPS chrominance channels 30 & 32 may be divided into a Red-to-Green channel 30 and a Blue-to-Yellow channel 32. These channels typically comprise the Cr and Cb channels of a YCrCb image, the "a" and "b" channels of a LAB image, the U and V channels of a YUV image, the I and Q channels of a YIQ image or similar channels of other color spaces or domains. These chrominance channels 30 & 32 are high-pass filtered 34 & 36 to remove low-frequency artifacts which occur during sub-pixel sampling.

In some embodiments of the present invention, high-pass filtering 34 & 36 may be performed via an unsharp mask method. The unsharp mask may use a low-pass kernel. Typically, the original image is processed with the low-pass kernel yielding a low-pass version of the image. This low-pass version is subsequently subtracted from the original unfiltered image while preserving the image's mean value. Successful embodiments have used a Gaussian low-pass kernel with a sigma of about 0.3 pixels to about 0.8 pixels. A sigma value of 0.6 pixels is thought to be particularly successful and results in a cut-off in the frequency domain of about 0.168 cycles/pixel. This gives a good unsharp-mask filter. The derivation for the Gaussian kernel is given below.

A one-dimensional Gaussian Function used in some embodiments is given as:

$$F(x) = \frac{1}{\sigma\sqrt{2\Pi}} e^{\frac{-x^2}{2\sigma^2}} \quad \mu = 0 \tag{1}$$

The Fourier transform of this function is given as:

$$F(k) = e^{-2\pi^2 k^2 \sigma^2} \tag{2}$$

Here we see that $\sigma$ in the space domain (units of pixels) corresponds to $1/\pi^2\sigma$ in frequency domain (units of cycles/pixel). This relation can be used to help determine the cut-off frequency of the filter given its $\sigma$, or, conversely, to determine the spatial $\sigma$ for the unsharp mask given a frequency, which may be guided by CSF models.

A 2-dimensional Gaussian function used in some embodiments is given as:

$$F(x, y) = \frac{1}{2\pi\sigma_x\sigma_y} e - \left(\frac{x^2}{2\sigma_x^2} + \frac{y^2}{2\sigma_y^2}\right), \ \mu_x, \ \mu_y = 0 \tag{3}$$

Since the Gaussian function is Cartesian separable, the frequency response of the 2-dimensional Gaussian function is similar to equation (2) when the significance of $\sigma$ is considered. That is, $\sigma_x$ in time domain is $1/\pi^2\sigma_x$ in frequency domain and $\sigma_y$ in time domain is $1/\pi^2\sigma_y$ in frequency domain.

A successful embodiment of the present invention has employed a Gaussian unsharp mask filter implemented with a kernel of size 3×3, with a value for sigma chosen as 0.6 resulting in a cut-off frequency of the low-pass filter around 0.2 cycles/pix.

Other embodiments of the present invention may use high-pass filters which are equivalent to the inverse CSFs for the respective opponent color channels. These CSFs may be mapped from the domain of cy/deg (where they are modeled) to the digital domain of cy/pix. The actual mapping process takes into account the viewing distance, and allows for customization for different applications, having particular display resolutions in pixels/mm and different expected or intended viewing distances. As a result of the methods of the present invention, chromatic artifacts will be invisible when viewed no closer than the designed viewing distance. However, the luminance resolution will be improved.

This filtering 34 & 36 may be performed for all chrominance channels 30 & 32 or for selected channels based on the amount or intensity of artifacts introduced in the particular sampling process or based on some other criteria.

Low-pass filtering 42 & 44 of the original OCD chrominance channels 38 & 40 may take place simultaneously with processing in the luminance pathway 45 or may take place at some other time. Low-pass filtering 42 & 44 of the OCD chrominance channels is performed to remove substantial chromatic frequencies above the display pixel Nyquist frequency. Accordingly, these channels may be sub-sampled 41 & 43 in a traditional manner by a factor of 1:3 without the generation of chromatic aliasing in the chromatic pathways 50.

Once filtering operations are complete, the segregated channels may be combined. Combination of chromatic channels will vary depending on the color domain used. In this exemplary embodiment, the high-pass filtered, sub-pixel sampled Blue-to-Yellow (HPFSPS-B/Y) chromatic channel is combined 46 with the low-pass filtered, traditionally sub-sampled Blue-to-Yellow (LPFSS-B/Y) chromatic channel to form a single high-low filtered (HLF) B/Y chromatic channel 51. The high-pass filtered, sub-pixel sampled Red-to-Green (HPFSPS-R/G) channel is also combined 52 with the low-pass filtered, traditionally sub-sampled Red-to-Green (LPFSS-R/G) channel to form a single high-low filtered (HLF) R/G channel 54.

It should be noted that the methods of embodiments of the present invention may be used in other color spaces and domains which may comprise other color channels and other quantities of color channels as well as other variations of luminance or lightness channels.

The combined HLF chrominance channels 51 & 54 may be further combined 28 with SPS luminance channel 26 to form a lower-resolution OCD image 56. Lower-resolution OCD image 56 may then be converted or otherwise transformed to other image formats or domains as required for various purposes.

The methods and systems of these embodiments provide a lower-resolution image with fewer visible chromatic artifacts.

Figure 9:
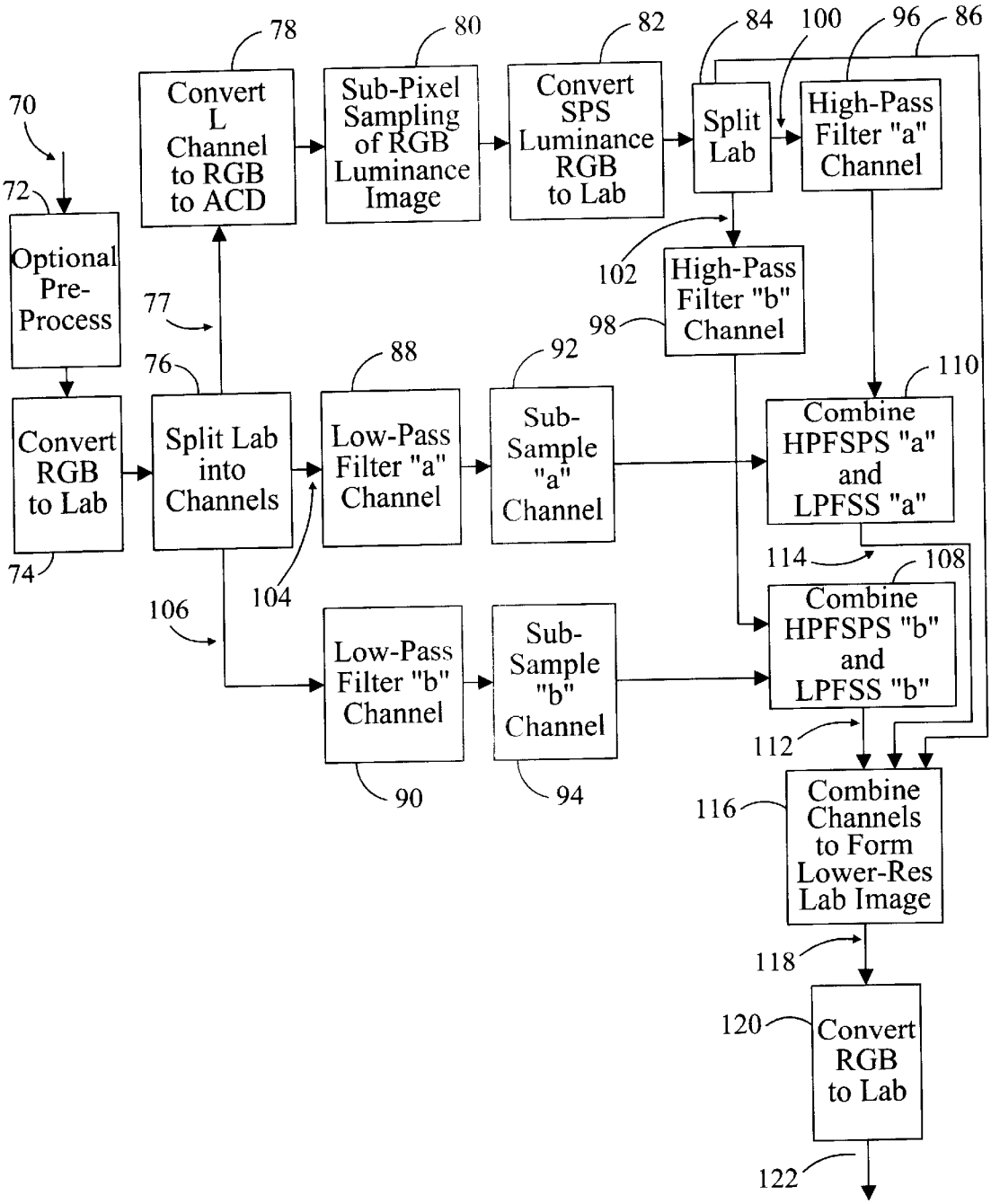
FIG. 9 is a diagram showing specific embodiments of the present invention.

In reference to FIG. 9, specific exemplary embodiments of the present invention may be explained. This particular embodiment may be used to process higher-resolution RGB images for display on a lower-resolution display device. A higher-resolution RGB image 70 may be optionally pre-processed 72 according to specific needs of a user or application. Pre-processing 72 may comprise hinting, types of low-pass filtering or some other processing techniques. Pre-processing 72 may also be bypassed altogether.

After any pre-processing 72, the RGB may be converted 74 to an opponent color domain image such as a LAB, YCrCb, YIQ, YUV or other image domain. In this example, the LAB image domain is used. Once converted to this domain, the image may be split 76 into the separate L, a, and b channels of the domain for separate processing of the channels. In this manner, the chrominance and luminance channels may be processed separately.

The "L" channel 77 is then converted 78 back to the RGB domain so that it may be sampled in its final display format. This conversion may comprise simple copying of the L layer or channel into three identical R, G, and B layers. A single layer may also be used, however, the actual conversion method will depend on the color transform chosen.

Sub-pixel sampling 80 is then performed on this RGB luminance image to preserve the horizontal luminance resolution of the original RGB image 70. After sub-pixel sampling, the sampled image is again converted 82 to an opponent color domain, such as LAB. This sampled LAB image is split 84 to isolate the luminance and chrominance channels for further processing of the chrominance channels. Here, the luminance channel 86 is typically not processed to preserve the original luminance data. However, the chrominance channels 100 & 102 of the sub-pixel sampled and split image are high-pass filtered 96 & 98 to remove low-frequency chromatic aliasing that occurs during sub-pixel sampling.

As in other embodiments explained above, this high-pass filtering may be performed with an unsharp-mask filter using a Gaussian low-pass kernel. In embodiments which use this method, the chrominance channels are filtered yielding a low-pass filtered chrominance image which is subtracted from the SPS-RGB chrominance image to create a "high-pass" filtered (HPF) SPS chrominance image or channel. High-pass filtering 96 & 98 is typically performed on both the "a" and "b" channels, but may be performed on only one channel when conditions permit.

Low-pass filtering 88 & 90 of the original "a" and "b" chrominance channels 104 & 106 may take place simultaneously with processing of the "L" channel or may take place at some other time. Low-pass filtering 88 & 90 of the "a" and "b" chrominance channels is performed to remove substantial chromatic frequencies above the display pixel Nyquist frequency. After low-pass filtering 88 & 90, these channels maybe sub-sampled 92 & 94 in a traditional manner by a factor of 1:3 without the generation of chromatic aliasing.

When channels have been filtered and sampled, they are combined to form a lower-resolution image with fewer errors. The high-pass filtered luminance "a" channel is combined 110 with the sub-sampled, low-pass filtered "a" channel to form a processed "a" channel 114. The high-pass filtered luminance "b" channel is combined 108 with the sub-sampled, low-pass filtered "b" channel to form a processed "b" channel 112. These chrominance channels 112 & 114 are then combined 116 with the SPS luminance channel 86 to form an error-reduced, lower-resolution LAB image 118.

This error-reduced image may be converted 120 to an RGB domain to produce an error-reduced, lower-resolution RGB image 122 which may be output to a display or other device.

Figure 10:
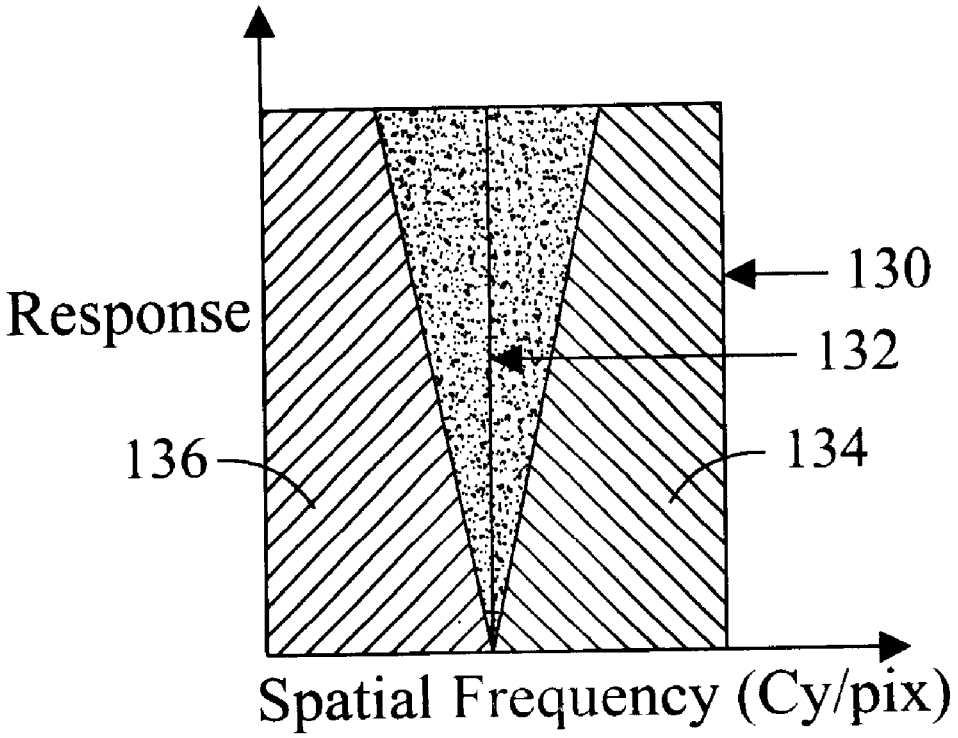
FIG. 10 is graph showing signals retained by embodiments of the present invention.

The functions of processes of embodiments of the present invention may be explained with reference to FIG. 10 which shows the signals retained relative to the luminance CSF 130 and chromatic CSF 132. The chromatic signals preserved include the high-pass region 134, which is undetectable to the chromatic CSF, as well as the low-pass region 136, which contains the useful chromatic content of the image. Ideally, the frequencies missing from this low-pass chromatic 136 will not be visible to the observer because of the RG and BY CSF's limited bandwidths. The HPF chromatic signal 134 is the chromatic aliasing that carries valid luminance info. Note that since the low frequency chromatic information is retained, this technique will work with color images. FIG. 10 shows no overlap between these two chromatic signals, but depending on the actual filters used, overlap may be possible. Other embodiments may include the use of filters that allow for overlap of the high-pass 134 and low-pass 136 chromatic signals shown in FIG. 10. Overlap can allow for more chromatic bandwidth at the expense of chromatic aliasing.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for converting a higher-resolution image to a lower-resolution image with reduced visible errors, said method comprising the acts of:

splitting a higher-resolution opponent color domain (OCD) image into separate initial luminance and initial chrominance channels;

performing sub-pixel sampling on said initial luminance channel thereby creating an additive color domain (ACD) luminance image;

converting said ACD luminance image into an OCD luminance image;

splitting said OCD luminance image into separate sub-pixel sampled (SPS) luminance and SPS chrominance channels;

high-pass filtering said SPS chrominance channels;

low-pass filtering said initial chrominance channels;

sub-sampling said filtered initial chrominance channels;

combining said sub-sampled, low-pass filtered chrominance channels with said high-pass filtered SPS chrominance channels; and combining said combined chrominance channels with said SPS luminance channel to form an error-reduced lower-resolution image.

2. The method of claim 1 wherein said higher-resolution image is an additive color domain image which is converted to an opponent color domain image prior to said splitting a higher-resolution OCD image.

3. The method of claim 1 wherein said additive color domain image is an RGB image.

4. The method of claim 1 wherein said opponent color domain images are YCrCb images.

5. The method of claim 1 wherein said opponent color domain images are LAB images.

6. The method of claim 1 wherein said high-pass filtering comprises unsharp-mask filtering.

7. The method of claim 1 wherein said high-pass filtering comprises the acts of:

filtering said SPS chrominance channels via an unsharp-mask filter with a Gaussian low-pass kernel resulting in low-pass SPS chrominance channels; and subtracting said SPS low-pass chrominance channels from said SPS chrominance channels to yield high-pass filtered SPS chrominance channels.

8. The method of claim 1 wherein said chrominance channels comprise a red-green channel and a blue-yellow channel.

9. The method of claim 1 wherein said chrominance channels comprise the Cr and Cb channels of a YCrCb image.

10. The method of claim 1 wherein said chrominance channels comprise the "a" and "b" channels of a CIELab image.

11. The method of claim 1 further comprising the act of transforming said error-reduced lower-resolution image to an RGB image.

12. The method of claim 1 wherein said act of performing sub-pixel sampling comprises converting said initial luminance channel into an additive color domain (ACD) luminance image and sampling said ACD luminance image.

13. A method for displaying a higher-resolution image at a lower-resolution with reduced visible errors, said method comprising the acts of:

converting a higher-resolution RGB image to a higher-resolution opponent color domain (OCD) image;

splitting said higher-resolution OCD image into separate initial luminance and initial chrominance channels;

converting said initial luminance channel into a RGB luminance image;

performing sub-pixel sampling on said RGB luminance image;

converting said sub-pixel sampled (SPS) RGB luminance image into a SPS OCD luminance image;

splitting said SPS-OCD luminance image into separate SPS luminance and SPS chrominance channels;

high-pass filtering said SPS chrominance channels;

low-pass filtering said initial chrominance channels of said higher-resolution OCD image;

sub-sampling said filtered initial chrominance channels;

combining said sub-sampled, low-pass filtered chrominance channels with said high-pass filtered SPS chrominance channels; and combining said combined chrominance channels with said SPS luminance channel to form an error-reduced OCD lower-resolution image; and converting said error-reduced OCD lower-resolution image to an error-reduced lower-resolution RGB image.

14. A method for converting a higher-resolution image to a lower-resolution image with reduced visible errors, said method comprising steps for:

splitting a higher-resolution opponent color domain (OCD) image into separate initial luminance and initial chrominance channels;

performing sub-pixel sampling on said initial luminance channel thereby creating an additive color domain (ACD) luminance image;

converting said ACD luminance image into an OCD luminance image;

splitting said OCD luminance image into separate sub-pixel sampled (SPS) luminance and SPS chrominance channels;

high-pass filtering said SPS chrominance channels;

low-pass filtering said initial chrominance channels;

sub-sampling said filtered initial chrominance channels;

combining said sub-sampled, low-pass filtered chrominance channels with said high-pass filtered SPS chrominance channels; and combining said combined chrominance channels with said SPS luminance channel to form an error-reduced lower-resolution image.

15. A system for converting a higher-resolution image to a lower-resolution image with reduced visible errors, said system comprising:

a first splitter for splitting a higher-resolution opponent color domain (OCD) image into separate initial luminance and initial chrominance channels;

a sub-pixel sampler for performing sub-pixel sampling on said initial luminance channel thereby creating an additive color domain (ACD) luminance image;

a converter for converting said ACD luminance image into an OCD luminance image;

a second splitter for splitting said OCD luminance image into separate sub-pixel sampled (SPS) luminance and SPS chrominance channels;

a high-pass filter for high-pass filtering said SPS chrominance channels;

a low-pass filter for low-pass filtering said initial chrominance channels;

a sub-sampler for sub-sampling said filtered initial chrominance channels;

a first combiner for combining said sub-sampled, low-pass filtered chrominance channels with said high-pass filtered SPS chrominance channels; and a second combiner for combining said combined chrominance channels with said SPS luminance channel to form an error-reduced lower-resolution image.

16. A computer readable medium comprising instructions for converting a higher-resolution image to a lower-resolution image with reduced errors, said instructions comprising the acts of:

splitting a higher-resolution opponent color domain (OCD) image into separate initial luminance and initial chrominance channels;

performing sub-pixel sampling on said initial luminance channel thereby creating an additive color domain (ACD) luminance image;

converting said ACD luminance image into an OCD luminance image;

splitting said OCD luminance image into separate sub-pixel sampled (SPS) luminance and SPS chrominance channels;

high-pass filtering said SPS chrominance channels;

low-pass filtering said initial chrominance channels;

sub-sampling said filtered initial chrominance channels;

combining said sub-sampled, low-pass filtered chrominance channels with said high-pass filtered SPS chrominance channels; and combining said combined chrominance channels with said SPS luminance channel to form an error-reduced lower-resolution image.

17. A computer data signal embodied in an electronic transmission, said signal having the function of converting a higher-resolution image to a lower-resolution image with reduced visible errors, said signal comprising instructions for:

splitting a higher-resolution opponent color domain (OCD) image into separate initial luminance and initial chrominance channels;

performing sub-pixel sampling on said initial luminance channel thereby creating an additive color domain (ACD) luminance image;

converting said ACD luminance image into an OCD luminance image;

splitting said OCD luminance image into separate sub-pixel sampled (SPS) luminance and SPS chrominance channels;

high-pass filtering said SPS chrominance channels;

low-pass filtering said initial chrominance channels;

sub-sampling said filtered initial chrominance channels;

combining said sub-sampled, low-pass filtered chrominance channels with said high-pass filtered SPS chrominance channels; and combining said combined chrominance channels with said SPS luminance channel to form an error-reduced lower-resolution image.

* * * * *